US009644860B2

(12) United States Patent
Yasutomi et al.

(10) Patent No.: US 9,644,860 B2
(45) Date of Patent: May 9, 2017

(54) AIRFLOW DIRECTION CONTROL DEVICE OF AIR-CONDITIONING INDOOR UNIT

(71) Applicant: DAIKIN INDUSTRIES, LTD., Osaka-shi, Osaka (JP)

(72) Inventors: Masanao Yasutomi, Kusatsu (JP); Masashi Kamada, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 386 days.

(21) Appl. No.: 14/354,559

(22) PCT Filed: Oct. 2, 2012

(86) PCT No.: PCT/JP2012/075458

§ 371 (c)(1),
(2) Date: Apr. 25, 2014

(87) PCT Pub. No.: WO2013/065436

PCT Pub. Date: May 10, 2013

(65) Prior Publication Data

US 2014/0273805 A1 Sep. 18, 2014

(30) Foreign Application Priority Data

Oct. 31, 2011 (JP) ..... 2011-239780

(51) Int. Cl.
*F24F 13/10* (2006.01)
*F24F 1/00* (2011.01)
(Continued)

(52) U.S. Cl.
CPC ..... *F24F 13/10* (2013.01); *F24F 1/0011* (2013.01); *F24F 13/14* (2013.01); *F24F 11/0078* (2013.01); *F24F 2221/28* (2013.01)

(58) Field of Classification Search
None
See application file for complete search history.

(56) References Cited

U.S. PATENT DOCUMENTS 5,478,276 A * 12/1995 Lee ..... F24F 11/0034 236/51
2006/0199504 A1* 9/2006 Moon ..... F24F 1/0011 454/229

(Continued)

FOREIGN PATENT DOCUMENTS

CN 1906447 A1 1/2007
EP 1 553 361 A1 7/2005

(Continued)

OTHER PUBLICATIONS

Machine translation of JP2006162220.*

(Continued)

*Primary Examiner* — Gregory Huson
*Assistant Examiner* — Martha Becton
(74) *Attorney, Agent, or Firm* — Global IP Counselors, LLP

(57) ABSTRACT

An air-conditioning indoor unit includes a blow-out port, a Coanda vane and a controller. The Coanda vane is-provided in proximity to the blow-out port. The Coanda vane turns the blown air into a Coanda airflow along a bottom surface of the Coanda vane. The controller performs a control in which a direction of the Coanda airflow is directed in a first direction by positioning the Coanda vane in a first orientation, and the direction of the Coanda airflow is directed in a second direction different from the first direction by positioning the Coanda vane in a second orientation different from the first orientation.

11 Claims, 11 Drawing Sheets

(51) Int. Cl.
*F24F 13/14* (2006.01)
*F24F 11/00* (2006.01)

(56) References Cited

U.S. PATENT DOCUMENTS

| | | | | |
|---|---|---|---|---|
| 2010/0036533 | A1* | 2/2010 | Masuda | F24F 11/0034 700/278 |
| 2010/0168921 | A1* | 7/2010 | Park | F24F 1/0011 700/276 |
| 2012/0234179 | A1* | 9/2012 | Miki | F24F 1/0007 96/397 |

FOREIGN PATENT DOCUMENTS

| | | | |
|---|---|---|---|
| EP | 1 707 892 | A1 | 10/2006 |
| EP | 1 707 893 | A1 | 10/2006 |
| JP | 6-101892 | A | 4/1994 |
| JP | 11-132540 | A | 5/1999 |
| JP | 2003-106555 | A | 4/2003 |
| JP | 2003-232531 | A | 8/2003 |
| JP | 2002-61938 | A | 2/2006 |
| JP | 2007-192480 | A | 8/2007 |
| JP | 2008-232532 | A | 10/2008 |
| JP | 2009-97755 | A | 5/2009 |
| JP | 2011-80623 | A | 4/2011 |
| JP | 2011-214727 | A | 10/2011 |
| JP | 2012-197970 | A | 10/2012 |

OTHER PUBLICATIONS

International Preliminary Report of corresponding PCT Application No. PCT/JP2012/075458.
Air Conditioner Tokesen Pamphlet S X Series, Panasonic Corp., Oct. 1, 2011, cover page, pp. 5, 6, 10 and 11.
Toriatsukai Setsumeisho, Panasonic Corp., Oct. 21, 2011, pp. 1, 6-8, 12, 13, 32-37 and 52.
Press Release Room Air Conditioner X Series, Sep. 6, 2011.
European Search Report of corresponding EP Application No. 12 84 6624.0 dated Jan. 5, 2015.

* cited by examiner

AIRFLOW DIRECTION CONTROL DEVICE OF AIR-CONDITIONING INDOOR UNIT

TECHNICAL FIELD

The present invention relates to an air-conditioning indoor unit.

CROSS-REFERENCE TO RELATED APPLICATIONS

This U.S. National stage application claims priority under 35 U.S.C. §119(a) to Japanese Patent Application No. 2011-239780, filed in Japan on Oct. 31, 2011, the entire contents of which are hereby incorporated herein by reference.

BACKGROUND ART

Recently there has been investigation of air conditioners that use the Coanda effect to bring the blown air to a predetermined zone. For example, in the air conditioner disclosed in Japanese Laid-open Patent Application Publication No. 2002-61938, a front surface inclined part of a front surface panel has a shape that is slightly inclined toward the ceiling. When conditioned air blown out from a blow-out port is deflected to the front surface inclined part by a vertical airflow direction plate, the conditioned air is led toward the ceiling along the front surface inclined part. As a result, the conditioned air can be brought farther along the ceiling surface.

SUMMARY OF INVENTION

Technical Problem

However, in an air conditioner such as the one described above, because a Coanda airflow is created using the Coanda effect of the front surface panel, a Coanda airflow in only one direction can be selected. Therefore, the direction of the Coanda airflow cannot be varied if there is any difference in the size and/or shape of the air conditioning target space or in the installed position of the air conditioner, or if there is an obstacle in the direction of the Coanda airflow.

An object of the present invention is to provide an air-conditioning indoor unit that can vary the direction of the Coanda airflow.

Solution to Problem

An air-conditioning indoor unit according to a first aspect of the present invention includes a blow-out port, a Coanda vane, and a controller. Blown air is blown out from the blow-out port. The Coanda vane, which is provided in proximity to the blow-out port, makes the blown air into a Coanda airflow along a bottom surface thereof. The controller performs a control so as to bring the direction of the Coanda airflow to a first direction by bringing the orientation of the Coanda vane to a first orientation, and to bring the direction of the Coanda airflow to a second direction different from the first direction by bringing the orientation of the Coanda vane to a second orientation different from the first orientation.

In this air-conditioning indoor unit, because the orientation of the Coanda vane can be varied to another orientation different from the current orientation, the direction of the Coanda airflow changes and the position reached by the Coanda airflow changes as well. As a result, the Coanda airflow can be varied to a direction suitable for surrounding conditions such as the size and/or shape of the air conditioning target space. For example, when the position reached by the Coanda airflow is varied according to the size of the air conditioning target space or when there is an obstacle in the direction of the Coanda airflow, the Coanda airflow can be directed in a direction that avoids the obstacle.

An air-conditioning indoor unit according to a second aspect of the present invention is the air-conditioning indoor unit according to the first aspect, and further includes a movable airflow direction adjustment vane for varying the vertical direction of the blown air. The orientation of the airflow direction adjustment vane varies with both the first orientation and the second orientation of the Coanda vane.

In this air-conditioning indoor unit, the direction of the Coanda airflow can be varied by the Coanda vane alone, but because the variation width thereof is not large, the allowable variation range of the Coanda airflow is enlarged by causing the direction of the blown air causing the Coanda airflow to vary using the airflow direction adjustment vane.

An air-conditioning indoor unit according to a third aspect of the present invention is the air-conditioning indoor unit according to the first or second aspect, and further includes a remote control for remotely operating the direction of the Coanda airflow. The orientation of the Coanda vane is selected by the remote control.

In this air-conditioning indoor unit, the user can, via the remote control, select at least between a mode of simply blowing conditioned air upward, and a mode of sending conditioned air far. For example, the conditioned air can be spread evenly throughout the air conditioning target space by selecting the mode of sending conditioned air far.

An air-conditioning indoor unit according to a fourth aspect of the present invention is the air-conditioning indoor unit according to the third aspect, wherein the remote control has a size input menu (means) for inputting the size of the air conditioning target space. The controller selects the orientation of the Coanda vane on the basis of the size of the air conditioning target space when the size of the air conditioning target space is inputted via the size input menu (means).

In this air-conditioning indoor unit, because the size of the air conditioning target space can be inputted via the remote control, the user can select the orientation of the Coanda vane and vary the direction of the Coanda airflow in accordance with the size of the room where the indoor unit is installed.

An air-conditioning indoor unit according to a fifth aspect of the present invention is the air-conditioning indoor unit according to the third aspect, wherein the remote control also has a distance input menu (means) for inputting an opposing distance from the blow-out port to an opposite wall forward from the blow-out port. The controller determines the orientation of the Coanda vane on the basis of the opposing distance when the opposing distance is inputted via the distance input menu (means).

In this air-conditioning indoor unit, because the user can input the opposing distance from the blow-out port to the forward opposite wall via the remote control, the orientation of the Coanda vane can be determined and the direction of the Coanda airflow can be varied in accordance with the opposing distance in the room where the indoor unit is installed, for example.

An air-conditioning indoor unit according to a sixth aspect of the present invention is the air-conditioning indoor unit according to the first or second aspect, and further includes a distance sensor. The distance sensor measures the distance from the blow-out port to an opposite wall forward from the blow-out port. The controller determines the orientation of the Coanda vane on the basis of the value measured by the distance sensor. This air-conditioning indoor unit is easily usable because there is no need for the user to input the opposing distance.

An air-conditioning indoor unit according to a seventh aspect of the present invention is the air-conditioning indoor unit according to the first aspect, wherein the orientations of the Coanda vane include at least a ceiling-blowing orientation for bringing the Coanda airflow to the ceiling. The controller adjusts the orientation of the airflow direction adjustment vane and/or the orientation of the Coanda vane in the ceiling-blowing orientation to regularly vary the position reached by the Coanda airflow.

When cold air or warm air continually contacts a single point on the ceiling, for example, there is a possibility of only the contacted surface becoming extremely soiled. There is also a possibility of dew condensation due to continual contact of cold air. Therefore, in this air-conditioning indoor unit, localized soiling and dew condensation on the ceiling can be suppressed by regularly varying the surface contacted by the airflow.

Advantageous Effects of Invention

In the air-conditioning indoor unit according to the first aspect of the present invention, because the orientation of the Coanda vane can be varied to another orientation different from the current orientation, the direction of the Coanda airflow changes and the position reached by the Coanda airflow changes as well. As a result, the Coanda airflow can be varied to a direction suitable for surrounding conditions such as the size and/or shape of the air conditioning target space.

In the air-conditioning indoor unit according to the second aspect of the present invention, the allowable variation range of the Coanda airflow is enlarged by causing the direction of the blown air causing the Coanda airflow to vary using the airflow direction adjustment vane.

In the air-conditioning indoor unit according to the third aspect of the present invention, the user can, via the remote control, select at least between a mode of simply blowing conditioned air upward, and a mode of sending conditioned air far.

In the air-conditioning indoor unit according to the fourth aspect of the present invention, because the size of the air conditioning target space can be inputted via the remote control, the user can select the orientation of the Coanda vane and vary the direction of the Coanda airflow in accordance with the size of the room where the indoor unit is installed.

In the air-conditioning indoor unit according to the fifth aspect of the present invention, because the user can input the opposing distance from the blow-out port to the forward opposite wall via the remote control, the orientation of the Coanda vane can be determined and the direction of the Coanda airflow can be varied in accordance with the opposing distance in the room where the indoor unit is installed, for example.

In the air-conditioning indoor unit according to the sixth aspect of the present invention is easily usable because there is no need for the user to input the opposing distance.

In the air-conditioning indoor unit according to the seventh aspect of the present invention, localized soiling and dew condensation on the ceiling can be suppressed by regularly varying the surface contacted by the airflow.

DESCRIPTION OF EMBODIMENTS

Embodiments of the present invention are described below with reference to the drawings. The following embodiments are specific examples of the present invention and are not intended to limit the technical scope of the present invention.

(1) Configuration of Air-Conditioning Indoor Unit 10

Figure 1:
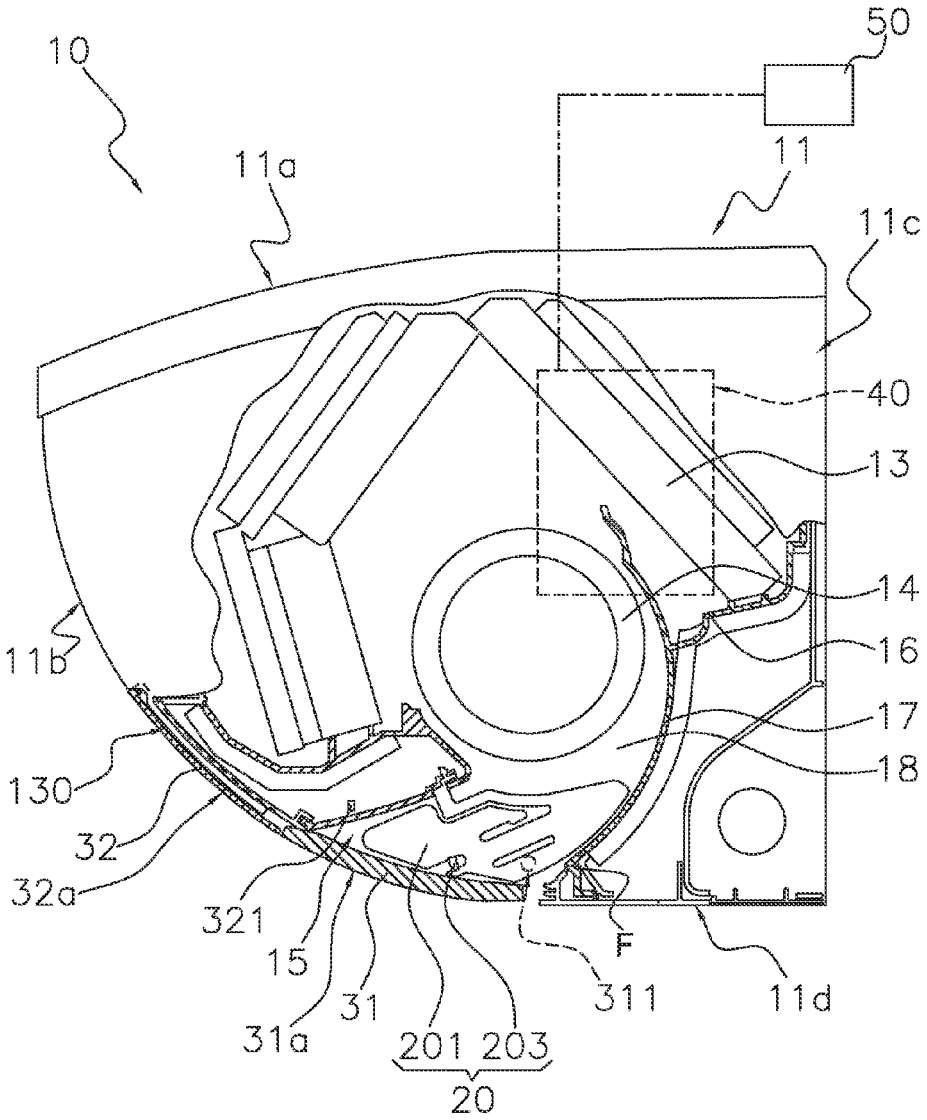
FIG. 1 is a cross-sectional view of an air-conditioning indoor unit according to an embodiment of the present invention when operation has stopped.
Figure 2:
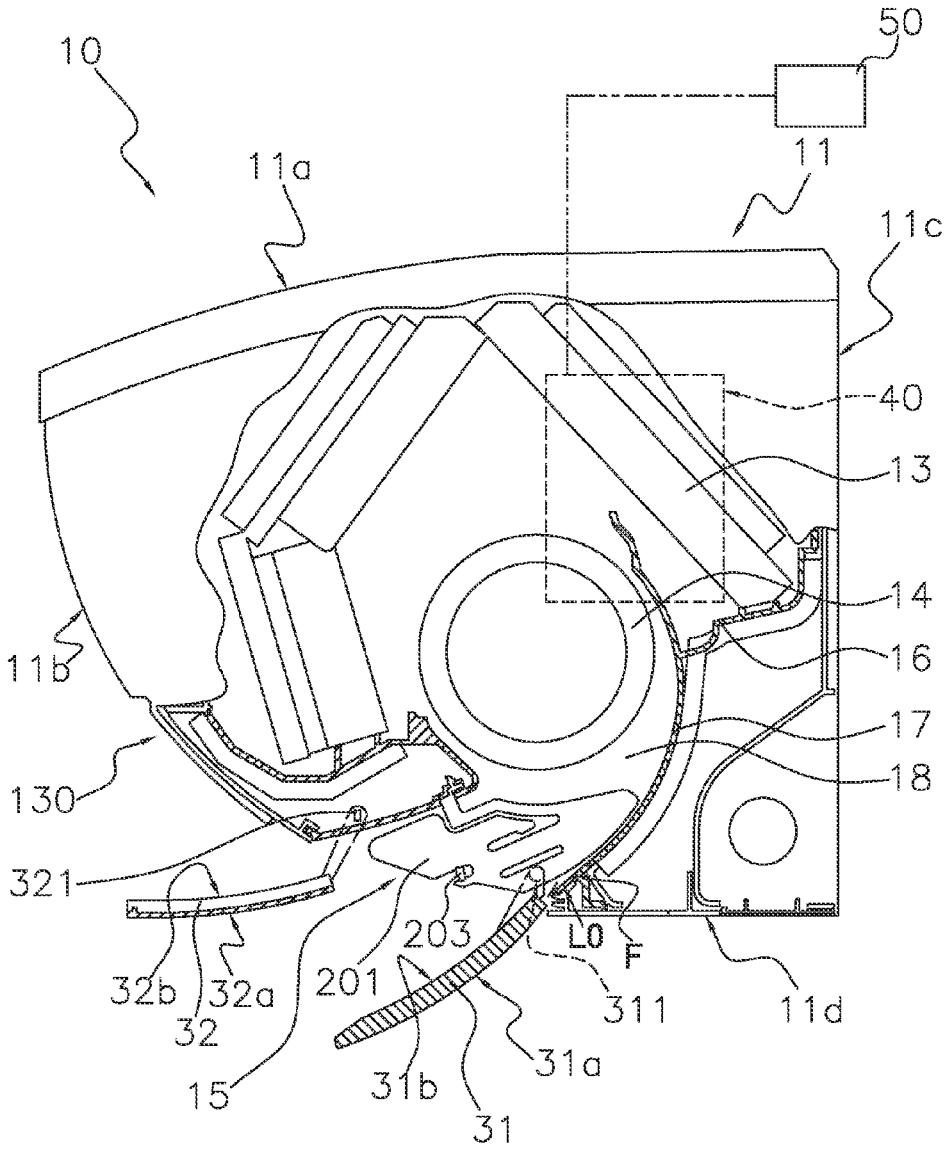
FIG. 2 is a cross-sectional view of the air-conditioning indoor unit while operating.

FIG. 1 is a cross-sectional view of an air-conditioning indoor unit 10 according to an embodiment of the present invention when operation has stopped. FIG. 2 is a cross-sectional view of the air-conditioning indoor unit 10 while operating. In FIGS. 1 and 2, the air-conditioning indoor unit 10 is a wall-mounted type unit, equipped with a main body casing 11, an indoor heat exchanger 13, an indoor fan 14, a bottom frame 16, and a controller 40.

The main body casing 11 has a top surface part 11*a*, a front surface panel 11*b*, a back surface plate 11*c*, and a bottom horizontal plate 11*d*, and the interior of the casing accommodates the indoor heat exchanger 13, the indoor fan 14, the bottom frame 16, and the controller 40.

The top surface part 11*a* is positioned in the top of the main body casing 11 and an intake port (not shown) is provided in the front of the top surface part 11*a*.

The front surface panel 11*b* constitutes the front surface part of the indoor unit, and has a flat shape with no intake port. The front surface panel 11*b* is also turnably supported at the top end on the top surface part 11*a*, and can be actuated in the manner of a hinge.

The indoor heat exchanger 13 and the indoor fan 14 are attached to the bottom frame 16. The indoor heat exchanger 13 conducts heat exchange with air passing therethrough. The indoor heat exchanger 13 also has a shape of inverted V that is bent with both ends extending downward as seen in a side view, and the indoor fan 14 is positioned under the indoor heat exchanger 13. The indoor fan 14, which is a cross flow fan, blows the air taken from within the room back out into the room after causing the air to pass through while in contact with the indoor heat exchanger 13.

A blow-out port 15 is provided in the bottom part of the main body casing 11. The blow-out port 15 is provided with a turnable airflow direction adjustment vane 31 for varying the direction of blown air that is blown out from the blow-out port 15. The airflow direction adjustment vane 31, which is driven by a motor (not shown), not only varies the direction of the blown air but can also open and close the blow-out port 15. The airflow direction adjustment vane 31 can assume a plurality of orientations of different incline angles.

A Coanda vane 32 is provided in proximity to the blow-out port 15. The Coanda vane 32 can be made by a motor (not shown) to assume an orientation inclined in the forward-backward direction, and when operation has stopped, the vane is accommodated in an accommodation part 130 provided to the front surface panel 11*b*. The Coanda vane 32 can assume a plurality of orientations of different incline angles.

The blow-out port 15 is joined with the interior of the main body casing 11 by a blow-out flow channel 18. The blow-out flow channel 18 is formed from the blow-out port 15 along a scroll 17 of the bottom frame 16.

Indoor air is drawn into the indoor fan 14 via the intake port and the indoor heat exchanger 13 by the working of the indoor fan 14, and is blown out from the indoor fan 14 and then from the blow-out port 15 via the blow-out flow channel 18.

The controller 40 is positioned to the right of the indoor heat exchanger 13 and the indoor fan 14 when the main body casing 11 is viewed from the front surface panel 11*b*, and the controller controls rotational speed of the indoor fan 14 and the actuating of the airflow direction adjustment vane 31 and the Coanda vane 32.

(2) Detailed Configuration (2-1) Front Surface Panel 11*b*

The front surface panel 11*b* extends in a slight arcuate curve from the top front of the main body casing 11 toward the front edge of the bottom horizontal plate 11*d*, as shown in FIG. 1. In the bottom part of the front surface panel 11*b* there is an area recessed toward the inside of the main body casing 11. The recessed depth of this area is set so as to match the thickness dimension of the Coanda vane 32, and this area constitutes the accommodation part 130 where the Coanda vane 32 is accommodated. The surface of the accommodation part 130 also has a slight curve.

(2-2) Blow-Out Port 15

The blow-out port 15, which is formed in the bottom part of the main body casing 11 as shown in FIG. 1, is a rectangular opening the long sides of which run in the horizontal direction (the direction orthogonal to the image plane of FIG. 1). The bottom end of the blow-out port 15 touches the front edge of the bottom horizontal plate 11*d*, and an imaginary plane joining the bottom and top ends of the blow-out port 15 is inclined forward and upward.

(2-3) Scroll 17

The scroll 17 is a dividing wall curved so as to face the indoor fan 14, and is part of the bottom frame 16. The final end F of the scroll 17 reaches the peripheral edge proximity of the blow-out port 15. Air passing through the blow-out flow channel 18 progresses along the scroll 17, and the air is sent tangentially to the final end F of the scroll 17. Therefore, if the blow-out port 15 did not have the airflow direction adjustment vane 31, the airflow direction of air blown out from the blow-out port 15 would flow substantially along a tangent L0 to the final end F of the scroll 17.

(2-4) Vertical Airflow Direction Adjustment Plate 20

A vertical airflow direction adjustment plate 20 has a plurality of vane pieces 201 and a linking rod 203 for linking the plurality of vane pieces 201 as shown in FIGS. 1 and 2. The vertical airflow direction adjustment plate 20 is disposed nearer to the indoor fan 14 than the airflow direction adjustment vane 31 within the blow-out flow channel 18.

The vane pieces 201 move left and right centered about a vertical state relative to the longitudinal direction of the blow-out port 15, due to the horizontal back-and-forth movement of the linking rod 203 along the longitudinal direction. The linking rod 203 is moved horizontally back and forth by a motor (not shown).

(2-5) Airflow Direction Adjustment Vane 31

The airflow direction adjustment vane 31 has a surface area sufficient to close the blow-out port 15. With the airflow direction adjustment vane 31 in a state of closing the blow-out port 15, the outer surface 31*a* thereof is finished to a convex and slightly arcuate curved surface in the outer side so as to be an extension of the curved surface of the front surface panel 11*b*. The inner surface 31*b* (see FIG. 2) of the airflow direction adjustment vane 31 is an arcuate curved surface substantially parallel to the outer surface.

The airflow direction adjustment vane 31 has a turning shaft 311 at the bottom end. The turning shaft 311, which is in proximity to the bottom end of the blow-out port 15, is linked to a rotating shaft of a stepping motor (not shown) fixed to the main body casing 11.

The turning shaft 311 turns counterclockwise in the front view of FIG. 1, whereby the top end of the airflow direction adjustment vane 31 is actuated so as to draw away from the top end of the blow-out port 15, thus opening the blow-out port 15. Conversely, the turning shaft 311 turns clockwise in the front view of FIG. 1, whereby the top end of the airflow direction adjustment vane 31 is actuated so as to draw near the top end of the blow-out port 15, thus closing the blow-out port 15.

With the airflow direction adjustment vane 31 in a state of leaving the blow-out port 15 open, the air blown out from the blow-out port 15 flows substantially along the inner surface 31*b* of the airflow direction adjustment vane 31. Specifically, the air blown out substantially tangentially to the final end F of the scroll 17 is varied in terms of airflow direction somewhat upward by the airflow direction adjustment vane 31.

(2-6) Coanda Vane 32

The Coanda vane 32 is accommodated in the accommodation part 130 while air-conditioning operation has stopped and during operation in a normal blow-out mode, described hereinafter. The Coanda vane 32 separates from the accommodation part 130 by turning. A turning shaft 321 of the Coanda vane 32 is provided to a position in proximity to the bottom end of the accommodation part 130 and on the inner side of the main body casing 11 (a position above the top wall of the blow-out flow channel 18), and the bottom end of the Coanda vane 32 and the turning shaft 321 are linked with a predetermined gap in between them. Therefore, the more the turning shaft 321 turns and the farther the Coanda vane 32 separates from the accommodation part 130 in the indoor unit front surface, the more the Coanda vane 32 rotates so that the bottom end thereof is positioned at a lower height. The incline when the Coanda vane 32 has rotated open is less than the incline of the indoor unit front surface.

In the present embodiment, the accommodation part 130 is provided outside of a blowing path, and the entire Coanda vane 32 when accommodated is accommodated on the outside of the blowing path. An alternative to this structure is one in which only part of the Coanda vane 32 is accommodated on the outside of the blowing path and the rest is accommodated within the blowing path (in the top wall part of the blowing path, for example).

The turning shaft 321 turns counterclockwise in the front view of FIG. 1, whereby both the top and bottom ends of the Coanda vane 32 separate from the accommodation part 130 while moving in an arc; but at this time, the shortest distance between the top end and the accommodation part 130 in the indoor unit front surface above the blow-out port is greater than the shortest distance between the bottom end and the accommodation part 130. Specifically, the Coanda vane 32 is controlled in an orientation so as to separate from the indoor unit front surface as the vane moves forward. The turning shaft 321 then turns clockwise in the front view of FIG. 1, whereby the Coanda vane 32 draws near the accommodation part 130 and is ultimately accommodated in the accommodation part 130. The orientations of the Coanda vane 32 in an operating state include being accommodated in the accommodation part 130, rotating to be inclined forward and upward, further rotating to be substantially horizontal, and further rotating to be inclined forward and downward.

With the Coanda vane 32 accommodated in the accommodation part 130, the outer surface 32*a* of the Coanda vane 32 is finished to a convex and slightly arcuate curved surface in the outer side so as to be an extension of the slightly arcuate curved surface of the front surface panel 11*b*. The inner surface 32*b* of the Coanda vane 32 is finished to an arcuate curved surface so as to run along the surface of the accommodation part 130.

The longitudinal dimension of the Coanda vane 32 is set so as to be equal to or greater than the longitudinal dimension of the airflow direction adjustment vane 31. The reason for this is because all of the blown air of which the airflow direction is adjusted by the airflow direction adjustment vane 31 is received by the Coanda vane 32, and the purpose is to prevent blown air from the sides of the Coanda vane 32 from short circuiting.

(3) Blown Air Direction Control

As means for controlling the direction of blown air, the air-conditioning indoor unit of the present embodiment has a normal blowing mode in which only the airflow direction adjustment vane 31 is turned to adjust the direction of blown air, a Coanda effect use mode in which the airflow direction adjustment vane 31 and the Coanda vane 32 are turned to make the blown air into a Coanda airflow along the outer surface 32*a* of the Coanda vane 32 due to the Coanda effect, and a blow down mode in which the distal ends of both the airflow direction adjustment vane 31 and the Coanda vane 32 are oriented forward and downward to lead the blown air downward.

Because the orientations of the airflow direction adjustment vane 31 and the Coanda vane 32 change with each blown direction of air in the modes described above, the orientations are described with reference to FIGS. 3A to 3E. The blown direction can be selected by the user through a remote control or the like. The mode and blown direction can also be controlled so as to vary automatically.

(3-1) Normal Blowing Mode

The normal blowing mode is a mode in which only the airflow direction adjustment vane 31 is turned to adjust the direction of blown air, and this mode includes "normal forward blowing" and "normal forward-downward blowing."

(3-1-1) Normal Forward Blowing

Figure 3A:
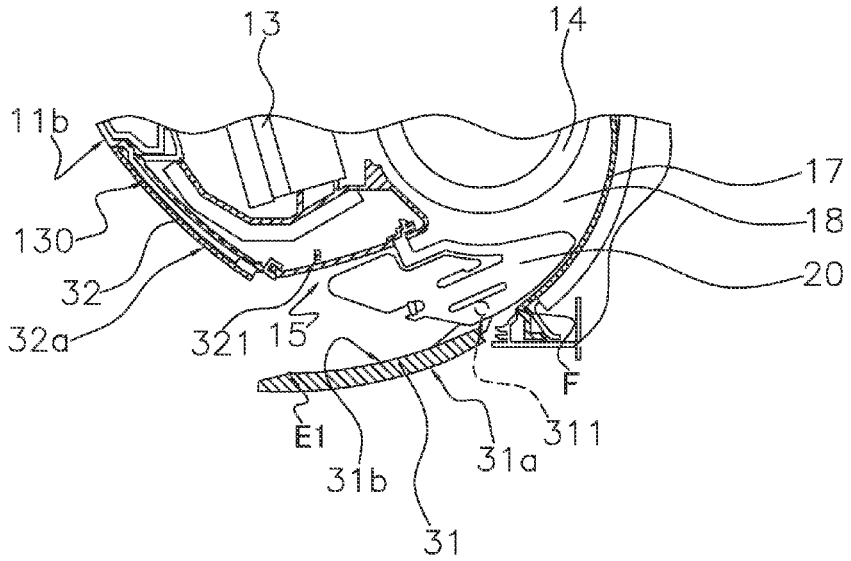
FIG. 3A is a side view of the airflow direction adjustment vane and the Coanda vane during normal forward blowing of blown air.

FIG. 3A is a side view of the airflow direction adjustment vane 31 and the Coanda vane 32 during normal forward blowing of blown air. In FIG. 3A, when the user selects "normal forward blowing," the controller 40 turns the airflow direction adjustment vane 31 until the inner surface 31*b* of the airflow direction adjustment vane 31 comes to a substantially horizontal position. When the inner surface 31*b* of the airflow direction adjustment vane 31 has an arcuate curved surface as in the present embodiment, the airflow direction adjustment vane 31 is turned until a tangent to the front end E1 of the inner surface 311*b* is substantially horizontal. As a result, the blown air is in a forward blowing state.

(3-1-2) Normal Forward-Downward Blowing

Figure 3B:
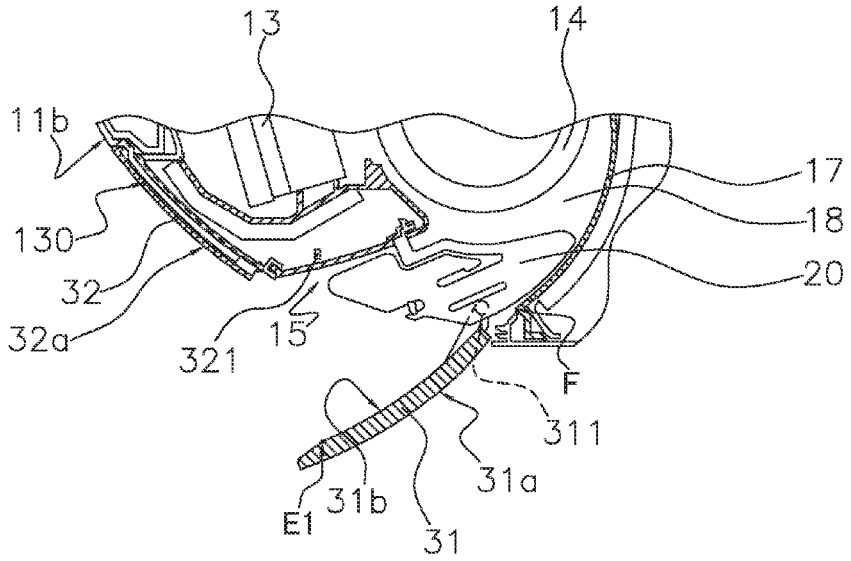
FIG. 3B is a side view of the airflow direction adjustment vane and the Coanda vane during normal forward-downward blowing of blown air.

FIG. 3B is a side view of the airflow direction adjustment vane 31 and the Coanda vane 32 during normal forward-downward blowing of blown air. In FIG. 3B, the user should select "normal forward-downward blowing" when desiring the blown direction to be further down than "normal forward blowing."

At this time, the controller 40 turns the airflow direction adjustment vane 31 until the tangent to the front end E1 of the inner surface 31*b* of the airflow direction adjustment vane 31 is oriented more forward and downward than horizontal. As a result, the blown air is in a forward-downward blowing state.

(3-2) Coanda Effect Use Mode

The term Coanda (effect) refers to a phenomenon whereby, when there is a wall next to a flow of a gas or liquid, the flow diverts toward a direction along the wall surface even if the flow direction and wall direction are different (Hōsoku no jiten, Asakura Publishing Co., Ltd.). The Coanda effect use mode includes "Coanda airflow forward blowing" and "Coanda airflow ceiling blowing" which use the Coanda effect.

Figure 4A:
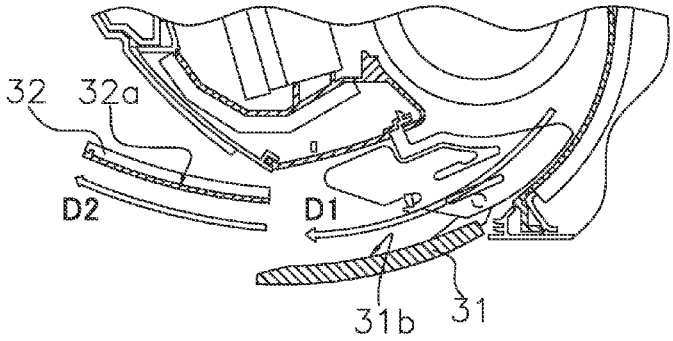
FIG. 4A is a schematic drawing showing the blown air direction and the Coanda airflow direction.

The method for defining the blown air direction and the Coanda airflow direction differs depending on how the reference position is found, and one example is therefore given below. However, the method is not limited to this example. FIG. 4A is a schematic drawing showing the blown air direction and the Coanda airflow direction. In FIG. 4A, to create a Coanda effect on the outer surface 32*a* of the Coanda vane 32, the incline of the blown air direction (D1) varied by the airflow direction adjustment vane 31 must be close to the orientation (incline) of the Coanda vane 32. When the two are too far apart, there is no Coanda effect. Therefore, in the present Coanda effect use mode, the Coanda vane 32 and the airflow direction adjustment vane 31 must have a predetermined opening angle or less, and both adjustment vanes (31, 32) are brought within this range to give rise to the relationship described above. After the airflow direction of the blown air is changed to D1 by the airflow direction adjustment vane 31, it is then changed to D2 by the Coanda effect as shown in FIG. 4A.

In the Coanda effect use mode of the present embodiment, the Coanda vane 32 is preferably in a position in front of (downstream of the blowing) and above the airflow direction adjustment vane 31.

Figure 4B:
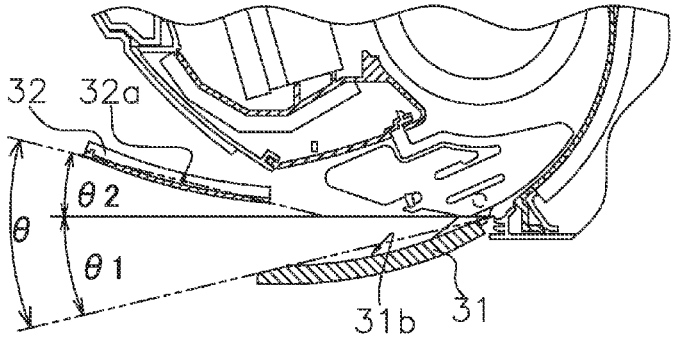
FIG. 4B is a schematic drawing showing an example of the opening angle between the airflow direction adjustment vane and the Coanda vane.

The method for defining the opening angle between the airflow direction adjustment vane 31 and the Coanda vane 32 differs depending on how the reference position is found, and one example is therefore given below. However, the method is not limited to this example. FIG. 4B is a schematic drawing showing an example of the opening angle of the airflow direction adjustment vane 31 and the Coanda vane 32. In FIG. 4B, the opening angle θ between the airflow direction adjustment vane 31 and the Coanda vane 32 is expressed as $\theta=\theta2-\theta1$, wherein the angle between a horizontal line and a straight line joining the front and rear ends of the inner surface 31*b* of the airflow direction adjustment vane 31 is the incline angle θ1 of the airflow direction adjustment vane 31, and the angle between the horizontal line and a straight line joining the front and rear ends of the outer surface 32*a* of the Coanda vane 32 is the incline angle θ2 of the Coanda vane 32. θ1 and θ2 are not absolute values, but are negative values when below the horizontal line in the front view of FIG. 4B.

In both "Coanda airflow forward blowing" and "Coanda airflow ceiling blowing," the airflow direction adjustment vane 31 and the Coanda vane 32 preferably assume orientations in which the inner angle formed by the tangent to the final end F of the scroll 17 and the Coanda vane 32 is greater than the inner angle formed by the tangent to the final end F of the scroll 17 and the airflow direction adjustment vane 31.

Figure 5A:
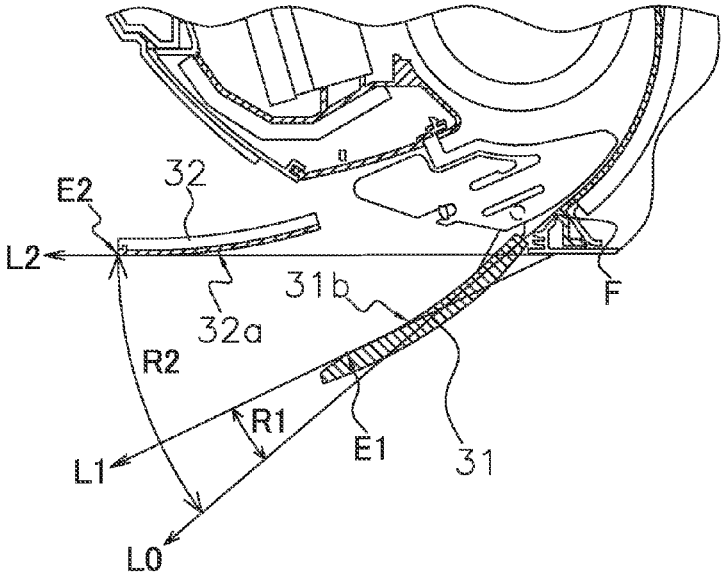
FIG. 5A is a comparative drawing, during Coanda airflow forward blowing, of the inner angle formed by the tangent to the final end F of the scroll and the Coanda vane, and the inner angle formed by the tangent to the final end F of the scroll and the airflow direction adjustment vane.
Figure 5B:
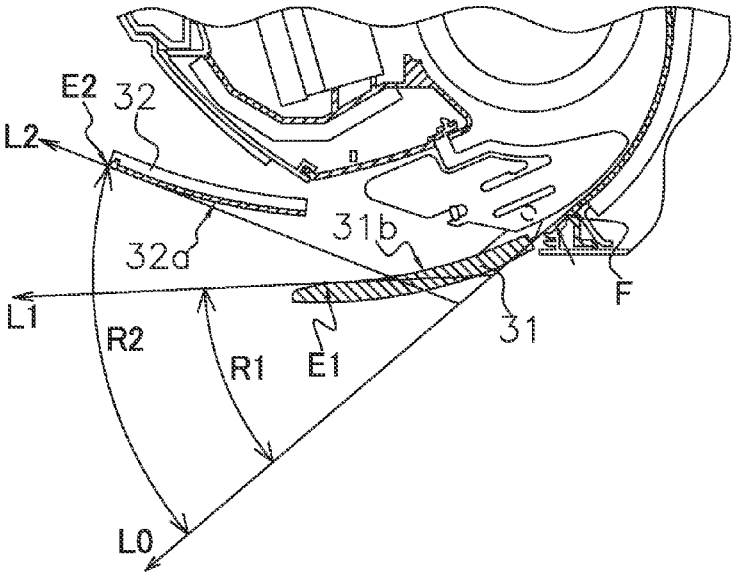
FIG. 5B is a comparative drawing, during Coanda airflow ceiling blowing, of the inner angle formed by the tangent to the final end F of the scroll and the Coanda vane, and the inner angle formed by the tangent to the final end F of the scroll and the airflow direction adjustment vane.

For the inner angle, refer to FIG. 5A (a comparative drawing, during Coanda airflow forward blowing, of the inner angle R2 formed by the tangent L0 to the final end F of the scroll 17 and the Coanda vane 32, and the inner angle R1 formed by the tangent L0 to the final end F of the scroll 17 and the airflow direction adjustment vane 31) and FIG. 5B (a comparative drawing, during Coanda airflow ceiling blowing, of the inner angle R2 formed by the tangent L0 to the final end F of the scroll 17 and the Coanda vane 32, and the inner angle R1 formed by the tangent L0 to the final end F of the scroll 17 and the airflow direction adjustment vane 31).

In the Coanda vane 32 during the Coanda effect use mode as shown in FIG. 5B, the distal end of the Coanda vane 32 is forward and above being horizontal, and is positioned farther outward and above the blow-out port 15. As a result, the Coanda airflow reaches further, strong airflows that would pass over the top side of the Coanda vane are suppressed, and upward diverting of the Coanda airflow is not likely to be inhibited.

The Coanda airflow is also created easily by the Coanda effect in the upstream side because the rear end of the Coanda vane 32 is at a lower height position than when operation has stopped.

(3-2-1) Coanda Airflow Forward Blowing

Figure 3C:
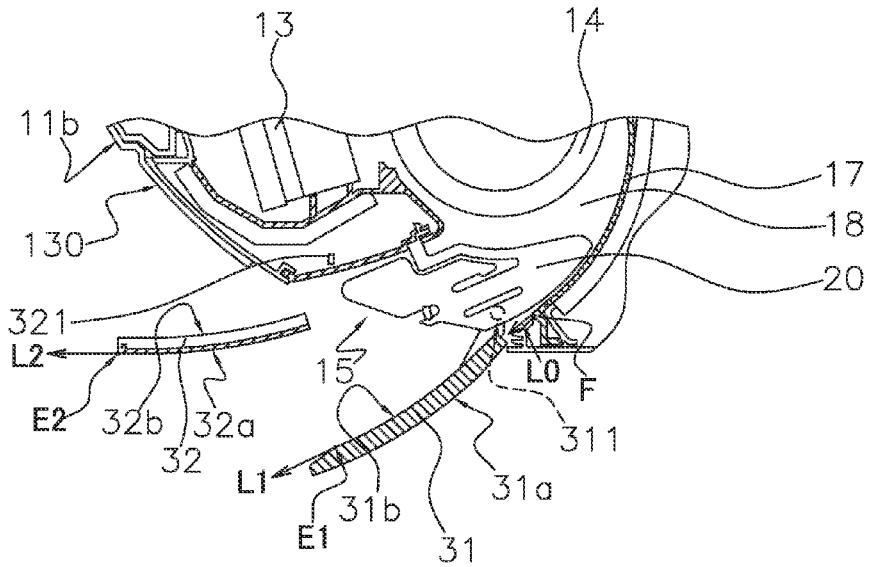
FIG. 3C is a side view of the airflow direction adjustment vane and the Coanda vane during Coanda airflow forward blowing.

FIG. 3C is a side view of the airflow direction adjustment vane 31 and the Coanda vane 32 during Coanda airflow forward blowing. In FIG. 3, when "Coanda airflow forward blowing" is selected, the controller 40 turns the airflow direction adjustment vane 31 until the tangent L1 to the front end E1 of the inner surface 31*b* of the airflow direction adjustment vane 31 is forward and lower than being horizontal.

Next, the controller 40 turns the Coanda vane 32 until the outer surface 32*a* of the Coanda vane 32 reaches a substantially horizontal position. When the outer surface 32*a* of the Coanda vane 32 has an arcuate curved surface as in the present embodiment, the Coanda vane 32 is turned until the tangent L2 to the front end E2 of the outer surface 32*a* is substantially horizontal. In other words, the inner angle R2 formed by the tangent L0 and the tangent L2 is greater than the inner angle R1 formed by the tangent L0 and the tangent L1, as shown in FIG. 5A.

The blown air adjusted to forward-downward blowing by the airflow direction adjustment vane 31 flows against the outer surface 32*a* of the Coanda vane 32 due to the Coanda effect, and changes to a Coanda airflow along the outer surface 32*a*.

Therefore, even if the direction of the tangent L1 to the front end E1 of the airflow direction adjustment vane 31 is forward-downward blowing, the direction of the tangent L2 to the front end E2 of the Coanda vane 32 is horizontal, and the blown air is therefore blown out in the direction of the tangent L2 to the front end E2 of the outer surface 32*a* of the Coanda vane 32, i.e. in a horizontal direction, due to the Coanda effect.

Thus, the Coanda vane 32 separates from the indoor unit front surface, lessening the incline, and the blown air is readily subjected to the Coanda effect further forward than the front surface panel 11*b*. As a result, even when the blown air of which the airflow direction is adjusted by the airflow direction adjustment vane 31 is blown forward and downward, the air is diverted horizontally by the Coanda effect.

This means that the airflow direction is varied while pressure loss due to the draft resistance of the airflow direction adjustment vane 31 is suppressed, more so than in a conventional (Patent Literature 1) method in which air immediately after passing through the blow-out port is brought near the front surface panel and directed upward by the Coanda effect of the front surface panel.

(3-2-2) Coanda Airflow Ceiling Blowing

Figure 3D:
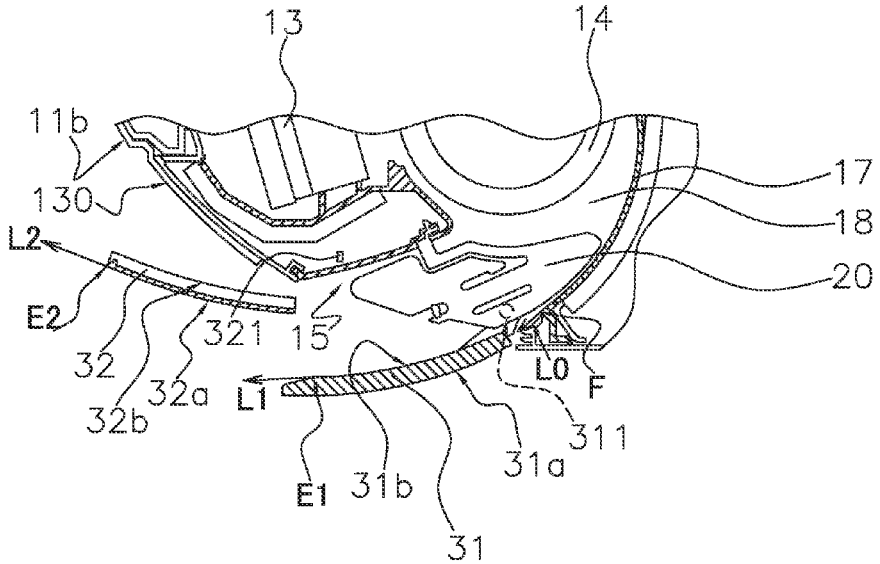
FIG. 3D is a side view of the airflow direction adjustment vane and the Coanda vane during Coanda airflow ceiling blowing.

FIG. 3D is a side view of the airflow direction adjustment vane 31 and the Coanda vane 32 during Coanda airflow ceiling blowing. In FIG. 3D, when "Coanda airflow ceiling blowing" is selected, the controller 40 turns the airflow direction adjustment vane 31 until the tangent L1 to the front end E1 of the inner surface 31*b* of the airflow direction adjustment vane 31 is horizontal.

Next, the controller 40 turns the Coanda vane 32 until the tangent L2 to the front end E2 of the outer surface 32*a* is oriented forward and upward. In other words, the inner angle R2 formed by the tangent L0 and the tangent L2 is greater than the inner angle R1 formed by the tangent L0 and the tangent L1, as shown in FIG. 5B. The blown air adjusted to horizontal blowing by the airflow direction adjustment vane 31 flows against the outer surface 32*a* of the Coanda vane 32 due to the Coanda effect, and changes to a Coanda airflow along the outer surface 32*a*.

Therefore, even when the direction of the tangent L1 to the front end E1 of the airflow direction adjustment vane 31 is forward blowing, the blown air is blown out in the direction of the tangent L2 to the front end E2 of the outer surface 32*a* of the Coanda vane 32, i.e. toward the ceiling due to the Coanda effect because the direction of the tangent L2 to the front end E2 of the Coanda vane 32 is forward-upward blowing. The Coanda airflow reaches farther because the distal end of the Coanda vane 32 protrudes farther outward than the blow-out port 15. Furthermore, because the distal end of the Coanda vane 32 is positioned higher than the blow-out port 15, airflows that would pass over the top side of the Coanda vane are suppressed, and upward diverting of the Coanda airflow is therefore not likely to be inhibited.

Thus, the Coanda vane 32 separates from the indoor unit front surface, lessening the incline, and the blown air is readily subjected to the Coanda effect farther forward than the front surface panel 11*b*. As a result, even when the blown air of which the airflow direction is adjusted by the airflow direction adjustment vane 31 is blown forward, the air is diverted upward by the Coanda effect. This means that the airflow direction is varied while pressure loss due to the draft resistance of the airflow direction adjustment vane 31 is suppressed, more so than in the conventional (Patent Literature 1) method in which air immediately after passing through the blow-out port is brought near the front surface panel and directed upward by the Coanda effect of the front surface panel.

As a result, the blown air is diverted toward the ceiling while the blow-out port 15 remains seemingly open, more so than in the invention disclosed in Patent Literature 1 in which an airflow is created along the front surface panel. In other words, the blown air is diverted toward the ceiling while the draft resistance is kept low.

The longitudinal dimension of the Coanda vane 32 is equal to or greater than the longitudinal dimension of the airflow direction adjustment vane 31. Therefore, all of the blown air of which the airflow direction is adjusted by the airflow direction adjustment vane 31 can be received by the Coanda vane 32, and the effect of preventing blown air from the sides of the Coanda vane 32 from short circuiting is also achieved.

(3-3) Downward Blowing Mode

Figure 3E:
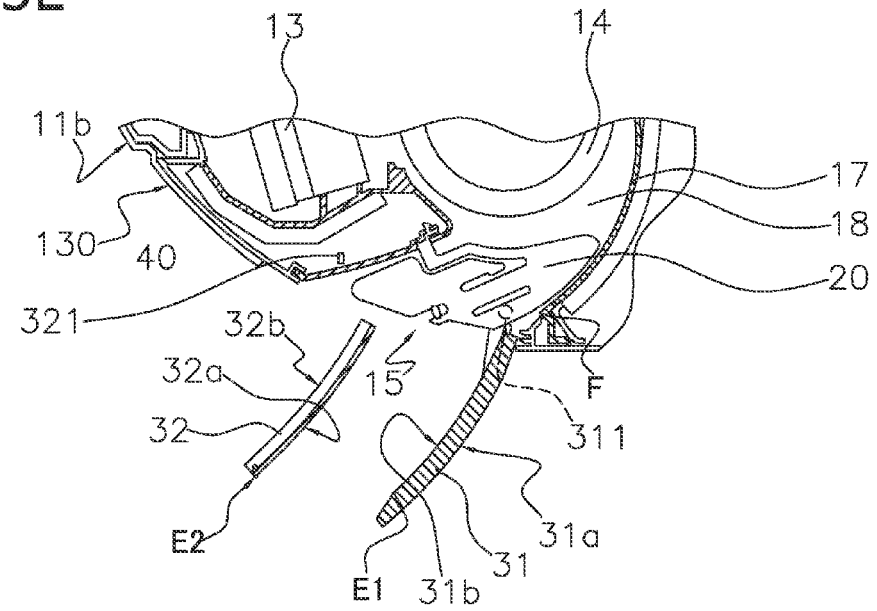
FIG. 3E is a side view of the airflow direction adjustment vane and the Coanda vane during downward blowing.

FIG. 3E is a side view of the airflow direction adjustment vane 31 and the Coanda vane 32 during downward blowing. In FIG. 3E, when "downward blowing" is selected, the controller 40 turns the airflow direction adjustment vane 31 until the tangent to the front end E1 of the inner surface 31*b* of the airflow direction adjustment vane 31 is oriented downward.

Next, the controller 40 turns the Coanda vane 32 until the tangent to the front end E2 of the outer surface 32*a* is oriented downward. As a result, the blown air is passed between the airflow direction adjustment vane 31 and the Coanda vane 32 and blown downward.

Particularly, even when the airflow direction adjustment vane 31 is oriented further downward than the tangent angle of the final end of the scroll 17, the controller 40 can create a downward airflow against the outer surface 32*a* of the Coanda vane 32 by implementing the downward blowing mode.

(4) Actuation

The actuation of the air-conditioning indoor unit, which uses the blown air direction control described above, is described below with reference to the drawings.

(4-1) First Orientation of Coanda Vane 32

Figure 6A:
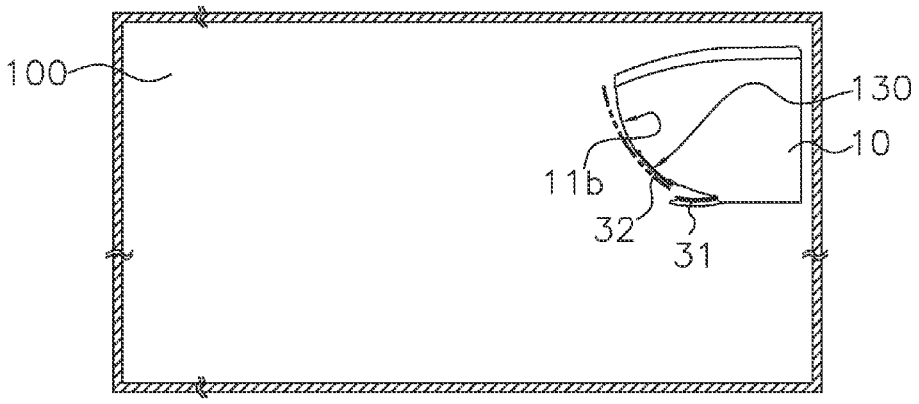
FIG. 6A is a side view of an installation space of the air-conditioning indoor unit, showing the airflow direction of the Coanda airflow when the Coanda vane assumes a first orientation.

FIG. 6A is a side view of an installation space of the air-conditioning indoor unit, showing the airflow direction of the Coanda airflow when the Coanda vane 32 assumes a first orientation. In FIG. 6A, the air-conditioning indoor unit 10 is installed at the top of an indoor side wall. The Coanda vane 32 is in a state of being accommodated in the accommodation part 130 (referred to hereinafter as the first orientation). Due to the orientation of the airflow direction adjustment vane 31 being more upward than horizontal when the Coanda vane 32 is in the first orientation, the blown air of which the airflow direction is adjusted by the inner surface 31*b* of the airflow direction adjustment vane 31 separates from the inner surface 31*b*, after which the direction of the air changes so as to be pulled to the outer surface 32*a* of the Coanda vane 32, and the air forms a first Coanda airflow and flows along the front surface panel 11*b* and the outer surface 32*a* of the Coanda vane 32.

Figure 7A:
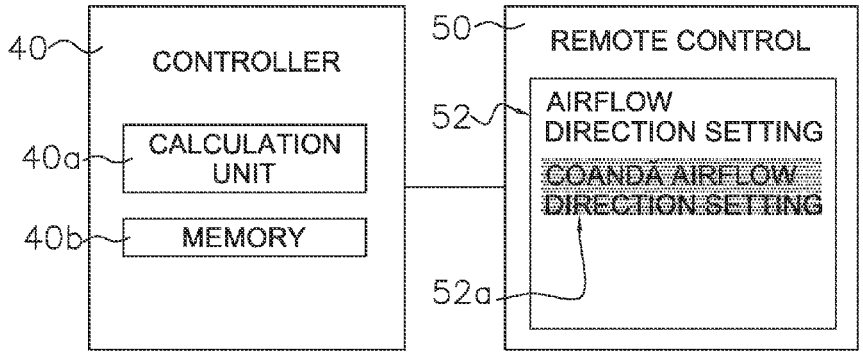
FIG. 7A is a block diagram showing the relationship between the controller and a remote control.

Herein is a description of the method whereby the user selects the Coanda airflow. FIG. 7A is a block diagram showing the relationship between the controller 40 and a remote control 50. In FIG. 7A, the remote control 50 transmits infrared signals wirelessly. The remote control 50 has switching means for switching the airflow direction. Specifically, the remote control has a display 52 for displaying airflow direction selection menus and a cursor 52*a* for indicating one of the airflow direction selection menus, so that the user can select the airflow direction.

First, the user uses the cursor 52*a* to select "Coanda airflow direction setting" from the menus displayed on the display 52. A detailed description is omitted because the techniques for selecting and confirming menus through the remote control 50 are widely publicly known.

Figure 7B:
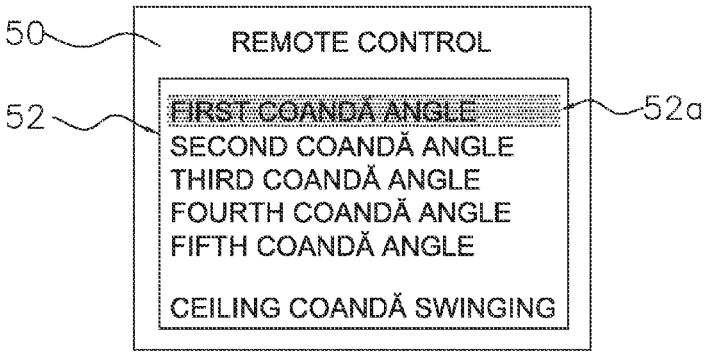
FIG. 7B is a front view of the display showing sub-menus of the "Coanda airflow direction setting" menu.

FIG. 7B is a front view of the display 52 showing sub-menus of the "Coanda airflow direction setting" menu. In FIG. 7B, first through fifth Coanda angles are prepared in advance in the sub-menus of the "Coanda airflow direction setting" menu and the first Coanda angle is indicated and confirmed with the cursor 52*a*, whereby the Coanda vane 32 assumes the first orientation shown in FIG. 6A, creating a Coanda airflow in a first direction corresponding to the first Coanda angle.

(4-2) Second Orientation and Third Orientation of Coanda Vane 32

Figure 6B:
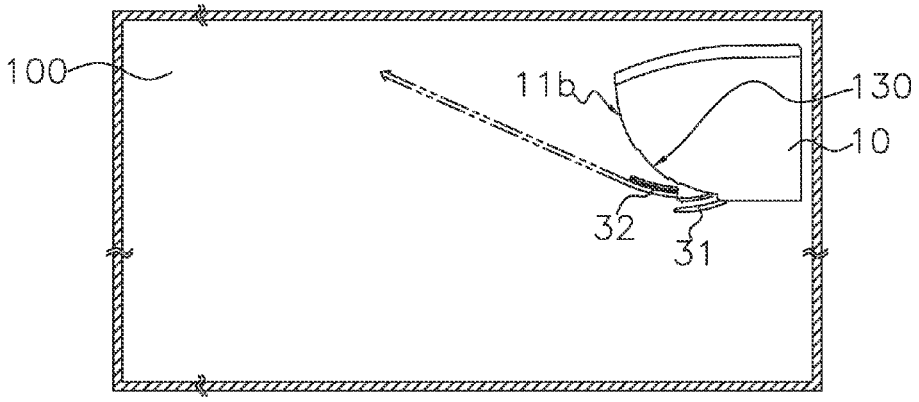
FIG. 6B is a side view of the installation space of the air-conditioning indoor unit, showing the airflow direction of the Coanda airflow when the Coanda vane assumes a second orientation.

Next, FIG. 6B is a side view of the installation space of the air-conditioning indoor unit, showing the airflow direction of the Coanda airflow when the Coanda vane 32 assumes the second orientation. The second orientation of the Coanda vane 32 in FIG. 6B is implemented by indicating and confirming the second Coanda angle with the cursor 52*a* in FIG. 7B. The Coanda airflow created when the Coanda vane 32 is in the second orientation is equivalent to the Coanda airflow described in the section "(3-2-2) Coanda airflow ceiling blowing." When the second Coanda angle is selected, the controller 40 turns the airflow direction adjustment vane 31 until the tangent L1 to the front end E1 of the inner surface 31*b* of the airflow direction adjustment vane 31 is horizontal, and then turns the Coanda vane 32 until the tangent L2 to the front end E2 of the outer surface 32*a* is oriented forward and upward, as shown in FIG. 3D. Therefore, even when the direction of the tangent L to the front end E1 of the airflow direction adjustment vane 31 is forward blowing, the blown air is blown out in the direction of the tangent L2 to the front end E2 of the outer surface 32*a* of the Coanda vane 32, i.e. toward the ceiling due to the Coanda effect, because the direction of the tangent L2 to the front end E2 of the Coanda vane 32 is forward-upward blowing.

Figure 8A:
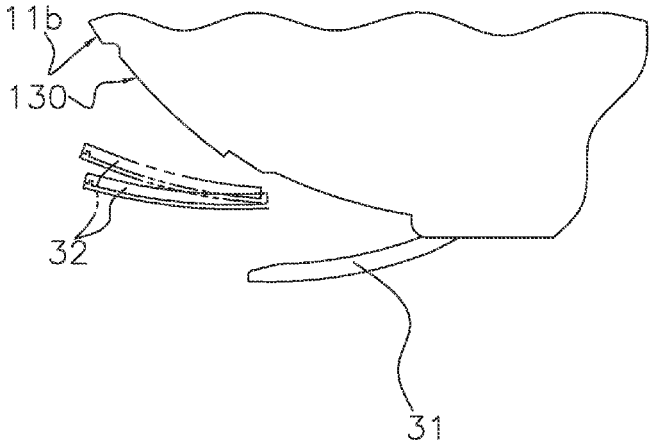
FIG. 8A is a side view of the airflow direction adjustment vane and the Coanda vane when the Coanda vane is in the third orientation.

Once a Coanda airflow has been created, the direction of the Coanda airflow can be adjusted by varying only the angle of the Coanda vane 32, without moving the airflow direction adjustment vane 31. For example, FIG. 8A is a side view of the airflow direction adjustment vane 31 and the Coanda vane 32 when the Coanda vane 32 is in the third orientation. In FIG. 8A, the third orientation of the Coanda vane 32 is further downward than the second orientation. For the sake of comparison in FIG. 8A, the Coanda vane 32 in the second orientation is shown by double-dashed lines, and the Coanda vane 32 in the third orientation is shown by solid lines.

Assuming a Coanda airflow is reliably created with the second orientation and the orientation of the airflow direction adjustment vane 31 does not change, it is clear that the Coanda airflow in the third orientation, which is further downward than the second orientation, does not break away from the outer surface 32*a* of the Coanda vane 32. Thus, when Coanda airflow ceiling blowing is to be implemented, it is achieved by selecting either the second Coanda angle or the third Coanda angle with the cursor 52*a* in FIG. 7B.

In the present embodiment, it is assumed that the second orientation and the third orientation of the Coanda vane 32 are selected to send conditioned air far. For example, when there is both a great height distance from the blow-out port 15 to the ceiling and a great opposing distance from the blow-out port 15 to the opposite wall, the orientation of the Coanda vane 32 is preferably the second orientation. On the other hand, in cases such as when there is a small height distance from the blow-out port 15 to the ceiling and a great opposing distance from the blow-out port 15 to the opposite wall, the orientation of the Coanda vane 32 is preferably the third orientation. Thus, the user can select the orientation of the Coanda vane 32 via the remote control 50 in accordance with the size of the indoor space, and conditioned air can therefore be spread evenly throughout the air conditioning target space in addition to the air-conditioning indoor unit being easily usable.

Switching between the second orientation and the third orientation of the Coanda vane 32 is also useful when the following such situation has occurred.

Figure 9A:
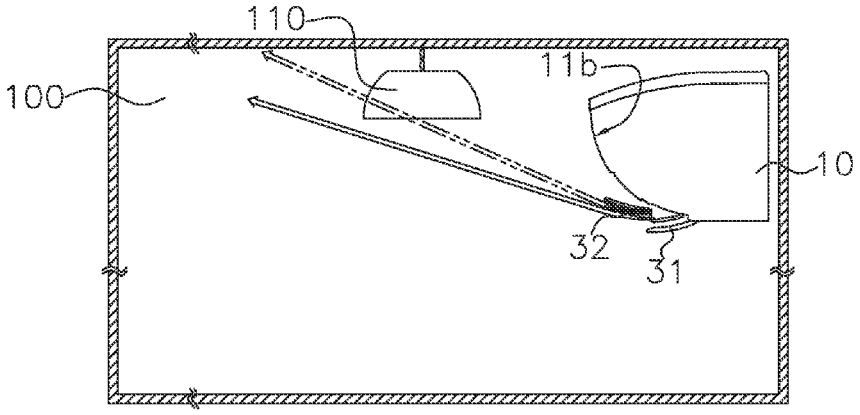
FIG. 9A is a side view of the installation space of the air-conditioning indoor unit, showing the airflow direction of the Coanda airflow when the Coanda vane assumes an upward orientation.

FIG. 9A is a side view of the installation space of the air-conditioning indoor unit, showing the airflow direction of the Coanda airflow when the Coanda vane 32 assumes an upward orientation. In FIG. 9A, the Coanda vane 32 drawn with the double-dashed lines is in the second orientation (see FIG. 6B). At this time, the Coanda airflow is heading toward a hanging lighting device 110 installed in the ceiling of the room, and there is therefore a risk that the lighting device 110 will swing and cause unease to an occupant of the room. In such cases, the third orientation can be selected to ensure that the Coanda airflow does not head toward the hanging lighting device 110.

(4-3) Fourth Orientation and Fifth Orientation of the Coanda Vane 32

Figure 6C:
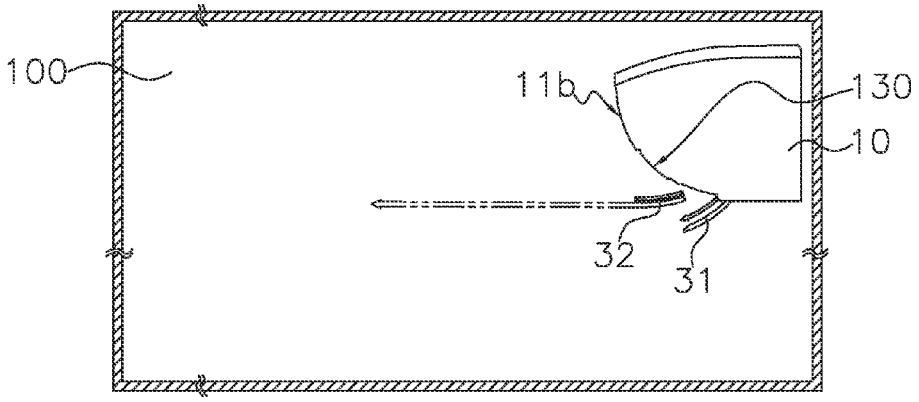
FIG. 6C is a side view of the installation space of the air-conditioning indoor unit, showing the airflow direction of the Coanda airflow when the Coanda vane assumes a fourth orientation.

Furthermore, FIG. 6C is a side view of the installation space of the air-conditioning indoor unit, showing the airflow direction of the Coanda airflow when the Coanda vane 32 assumes the fourth orientation. The fourth orientation of the Coanda vane 32 in FIG. 6C is implemented by indicating and confirming the fourth Coanda angle with the cursor 52*a* in FIG. 7B. The Coanda airflow created when the Coanda vane 32 is in the fourth orientation is equivalent to the Coanda airflow described in the section "(3-2-1) Coanda airflow forward blowing." When the fourth Coanda angle is selected, the controller 40 turns the airflow direction adjustment vane 31 until the tangent L1 to the front end E1 of the inner surface 31*b* of the airflow direction adjustment vane 31 is more forward and downward than horizontal, and then turns the Coanda vane 32 until the outer surface 32*a* of the Coanda vane 32 is substantially horizontal, as shown in FIG. 3C. Therefore, even when the direction of the tangent L1 to the front end E1 of the airflow direction adjustment vane 31 is forward-downward blowing, the blown air is blown out in the direction of the tangent L2 to the front end E2 of the outer surface 32*a* of the Coanda vane 32, i.e., horizontally, due to the Coanda effect, because the direction of the tangent L2 to the front end E2 of the Coanda vane 32 is horizontal.

Figure 8B:
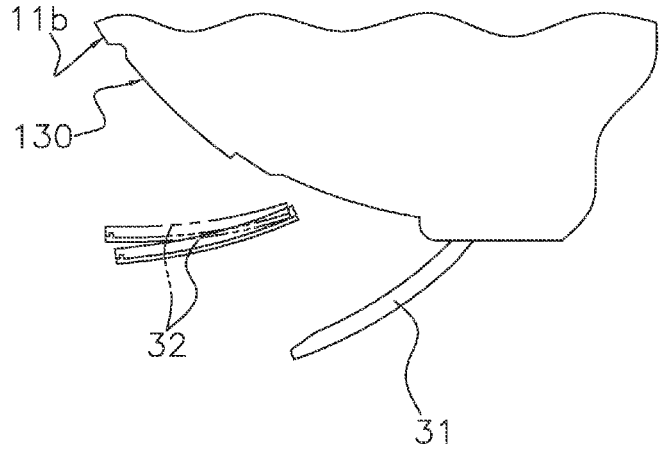
FIG. 8B is a side view of the airflow direction adjustment vane and the Coanda vane when the Coanda vane is in the fifth orientation.

Once a Coanda airflow has been created, the direction of the Coanda airflow can be adjusted by varying only the angle of the Coanda vane 32, without moving the airflow direction adjustment vane 31. For example, FIG. 8B is a side view of the airflow direction adjustment vane 31 and the Coanda vane 32 when the Coanda vane 32 is in the fifth orientation. In FIG. 8B, the fifth orientation of the Coanda vane 32 is further downward than the fourth orientation. For the sake of comparison in FIG. 8B, the Coanda vane 32 in the fourth orientation is shown by double-dashed lines, and the Coanda vane 32 in the fifth orientation is shown by solid lines.

Assuming a Coanda airflow is reliably created with the fourth orientation and the orientation of the airflow direction adjustment vane 31 does not change, it is clear that the Coanda airflow in the fifth orientation, which is further downward than the fourth orientation, does not break away from the outer surface 32*a* of the Coanda vane 32. Thus, when Coanda airflow forward blowing is to be implemented, it is achieved by selecting either the fourth Coanda angle or the fifth Coanda angle with the cursor 52*a* in FIG. 7B.

As is clear from the description above, the orientation of the airflow direction adjustment vane 31 varies with the first orientation, the second orientation, and the fourth orientation of the Coanda vane 32. In other words, the Coanda airflow created by the Coanda vane 32 can be directed in any direction by the combination of the orientation of the airflow direction adjustment vane 31 and the orientation of the Coanda vane 32.

(4-4) Special Actuation

Figure 9B:
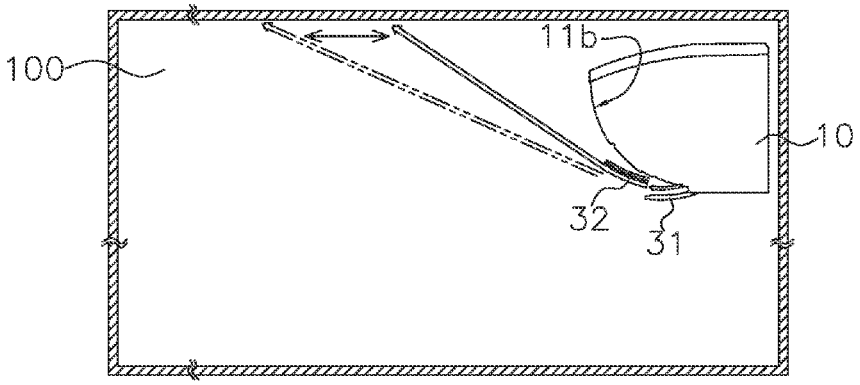
FIG. 9B is a side view of the installation space of the air-conditioning indoor unit, showing the airflow direction of the Coanda airflow when the Coanda vane swings in the ceiling-blowing orientation.

FIG. 9B is a side view of the installation space of the air-conditioning indoor unit, showing the airflow direction of the Coanda airflow when the Coanda vane 32 swings in the ceiling-blowing orientation. In FIG. 9B, when the air-conditioning indoor unit 10 is used for a long period of time while remaining in an orientation that directs the Coanda airflow toward the ceiling, the dirt in the area of the ceiling surface that is constantly exposed to the Coanda airflow becomes more conspicuous than in other areas, and the room is aesthetically compromised. There is also a possibility of dew condensation due to cold air continually contacting one area of the ceiling.

In view of this, in the present embodiment, the orientation can be made to regularly vary while the Coanda vane 32 remains in the ceiling-blowing orientation, due to the user selecting the "ceiling Coanda swinging" menu (see FIG. 7B) from the remote control 50. As a result, localized soiling and/or dew condensation on the ceiling can be suppressed with the air-conditioning indoor unit 10.

(5) Characteristics (5-1)

In the air-conditioning indoor unit 10, the controller 40 performs a control so as to bring the direction of the Coanda airflow to a first direction by bringing the orientation of the Coanda vane 32 to a first orientation, and to bring the direction of the Coanda airflow to a second direction different from the first direction by bringing the orientation of the Coanda vane 32 to a second orientation different from the first orientation. At this time, the orientation of the airflow direction adjustment vane 31 may vary with the first orientation and the second orientation of the Coanda vane 32. The orientation of the Coanda vane 32 is selected by the remote control 50. In the air-conditioning indoor unit 10, the Coanda airflow can be varied to a direction suitable for surrounding conditions such as the size and/or shape of the air conditioning target space.

(5-2)

In the air-conditioning indoor unit 10, the controller 40 adjusts the orientation of the airflow direction adjustment vane 31 and/or the Coanda vane 32 in the ceiling-blowing orientation to regularly vary the position reached by the Coanda airflow. Therefore, in this air-conditioning indoor unit 10, localized soiling and dew condensation on the ceiling can be suppressed by regularly varying the surface contacted by the airflow.

(6) Modifications (6-1) First Modification

In the above embodiment, the second orientation and third orientation of the Coanda vane 32 are selected to send conditioned air far, and the user can, via the remote control 50, select the orientation of the Coanda vane 32 in accordance with the size of the indoor space.

However, there could also be cases in which the second orientation and third orientation of the Coanda vane 32 are not suitable for a specified indoor space. In view of this, in the first modification, the size of the indoor space where the air-conditioning indoor unit 10 is installed is inputted in advance from the remote control 50, and the angles of the Coanda vane 32 in the second orientation and third orientation are thereby automatically corrected to angles suitable for this indoor space.

Figure 10A:
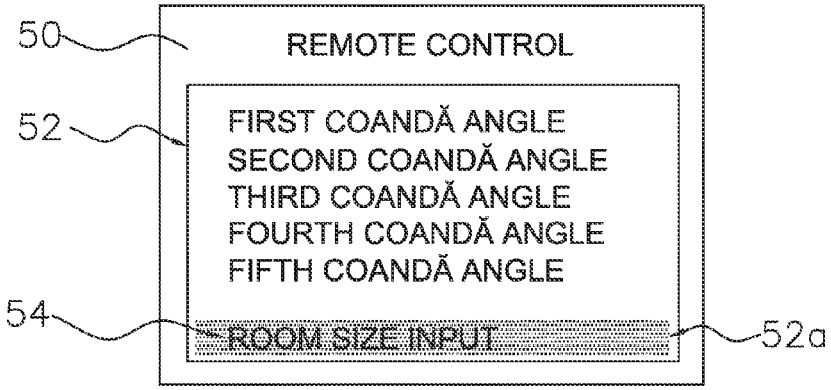
FIG. 10A is a front view of the display according to the first modification, showing sub-menus of the "Coanda airflow direction setting" menu.

FIG. 10A is a front view of the display according to the first modification, showing sub-menus of the "Coanda airflow direction setting" menu. In FIG. 10A, a "room size input" menu 54 is included among the sub-menus of the "Coanda airflow direction setting" menu. The user can input the room size from the display 52 by indicating and confirming the "room size input" menu 54 with the cursor 52*a*. The room size is preferably defined by the height distance from the blow-out port 15 to the ceiling, and the opposing distance from the blow-out port 15 to the opposite wall, for example.

(6-2) Second Modification

Commonly, the standard height from the floor of a room to the ceiling is 2 m 40 cm and the air-conditioning indoor unit 10 is installed at a height so that the gap to the ceiling surface is about 10 cm. Therefore, storing the installation height of the air-conditioning indoor unit 10 in advance in memory 40*b* (see FIG. 7A) makes it possible for a calculation unit 40*a* (see FIG. 7A) to calculate the height distance from the blow-out port 15 to the ceiling, and the user therefore needs only to input the opposing distance to the opposite wall from the blow-out port 15.

Figure 10B:
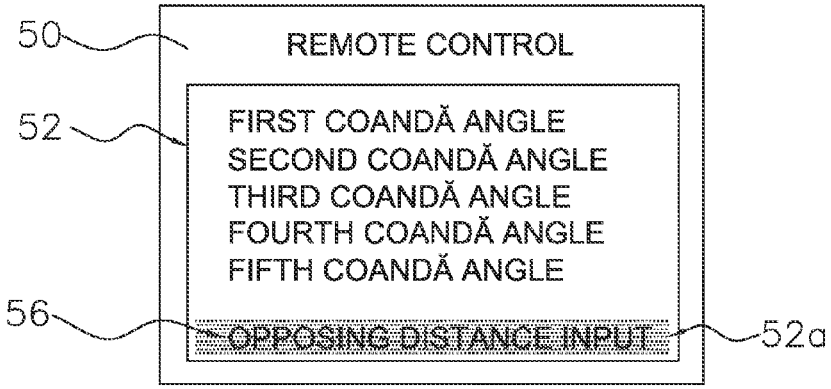
FIG. 10B is a front view of the display according to the second modification, showing sub-menus of the "Coanda airflow direction setting" menu.

FIG. 10B is a front view of the display according to the second modification, showing sub-menus of the "Coanda airflow direction setting" menu. In FIG. 10B, an "opposing distance input" menu 56 is included among the sub-menus of the "Coanda airflow direction setting" menu. The user is able to input the opposing distance from the display 52 by indicating and confirming the "opposing distance input" menu 56 with the cursor 52*a*. In other words, the user inputs only the opposing distance in advance, and the angles of the Coanda vane 32 in the second orientation and third orientation are thereby automatically corrected to angles suitable for this indoor space.

(6-3) Third Modification

Furthermore, if it is possible for the opposing distance to be measured by a sensor, there will not be a need to input the opposing distance as in the second modification, and the air-conditioning indoor unit will be even more easily usable.

Figure 10C:
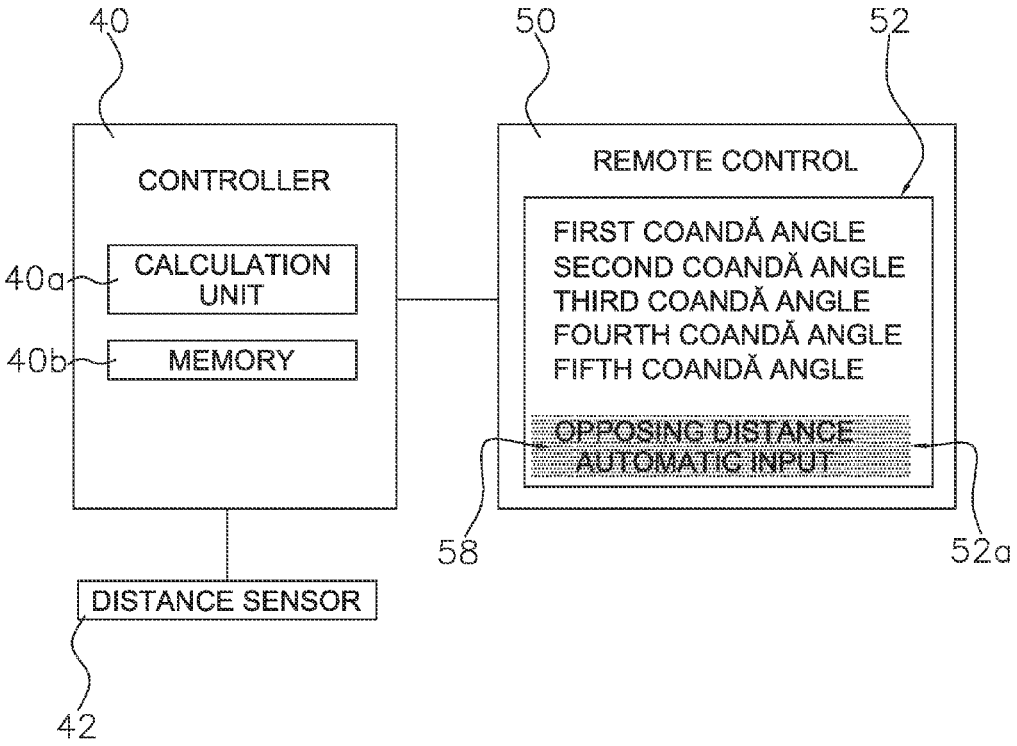
FIG. 10C is a block diagram showing the relationship between the controller, a distance sensor, and the remote control.

FIG. 10C is a block diagram showing the relationship between the controller 40, a distance sensor 42, and the remote control 50. In FIG. 10C, an "opposing distance automatic input" menu 58 is included among the sub-menus of the "Coanda airflow direction setting" menu. The user indicates and confirms the "opposing distance automatic input" menu 58 with the cursor 52*a*, whereby the distance sensor 42 measures the distance from its own position to the opposite wall surface, the distance is stored in the memory 40*b*, and the opposing distance from the blow-out port 15 to the opposite wall is calculated by the calculation unit 40*a*. In other words, the user does not need to input the opposing distance but needs only to select the "opposing distance automatic input" menu 58, whereby the angles of the Coanda vane 32 in the second orientation and the third orientation are automatically corrected to angles suitable for the indoor space.

INDUSTRIAL APPLICABILITY

The present invention is useful as a wall-mounted air-conditioning indoor unit.

What is claimed is:

1. An airflow direction control device of an air-conditioning indoor unit capable of causing a flow of blown air blown out from a blow-out port to be diverted in a predetermined direction due to the Coanda effect, the airflow direction control device of the air-conditioning indoor unit comprising:

a positionable Coanda vane provided in proximity to the blow-out port, the Coanda vane being arranged and configured to turn the blown air into a Coanda airflow along a bottom surface thereof due to the Coanda effect;

a movable airflow direction adjustment vane arranged and configured to vary a vertical direction of the blown air, the airflow direction adjustment vane being positioned at a bottom of die blowout port such that airflow only flows on an upper side of the airflow direction adjustment vane;

a first driving unit configured to drive the Coanda vane;

a second driving unit configured to drive the airflow direction adjustment vane; and a controller configured to perform a control in which a direction of the Coanda airflow is directed in a first direction by positioning the Coanda vane in a first orientation by controlling the first driving unit, the direction of the Coanda airflow is directed in a second direction different orientation different from the first orientation by further controlling the first driving unit, and an orientation of the airflow direction adjustment vane varies with the first orientation and the second orientation of the Coanda vane by controlling the second driving unit.

2. The airflow direction control device of the air-conditioning indoor unit according to claim 1, further comprising a remote control configured to remotely operate the controller to control the direction of the Coanda airflow, the orientation of the Coanda vane being selected by the remote control.

3. The airflow direction control device of the air-conditioning indoor unit according to claim 2, wherein the remote control has a size input menu usable to input a size of an air conditioning target space; and the controller is configured to select the orientation of the Coanda vane based on the size of the air conditioning target space when the size of the air conditioning target space is inputted via the size input menu.

4. The airflow direction control device of the air-conditioning indoor unit according to claim 2, wherein the remote control has a distance input menu usable to input an opposing distance from the blow-out port to an opposite wall forward from the blow-out port, and the controller is configured to determine the orientation of the Coanda vane based on the opposing distance when the opposing distance is inputted via the distance input menu.

5. The airflow direction control device of the air-conditioning indoor unit according to claim 1, further comprising a distance sensor arranged and configured to measure a distance from the blow-out port to an opposite wall forward from the blow-out port, the controller is configured to determine the orientation of the Coanda vane based on a value measured by the distance sensor.

6. The airflow direction control device of the air-conditioning indoor unit according to claim 1, wherein the Coanda vane is positionable in plural orientations including at least a ceiling-blowing orientation in which the Coanda airflow is turned to the ceiling; and the controller is configured to adjust at least one of an orientation of the airflow direction adjustment vane and the orientation of the Coanda vane in the ceiling-blowing orientation in order to regularly vary a position of the Coanda airflow.

7. The airflow direction control device of the air-conditioning indoor unit according to claim 1, further comprising a remote control configured to remotely operate the controller to control the direction of the Coanda airflow, the orientation of the Coanda vane being selected by the remote control.

8. The airflow direction control device of the air-conditioning indoor unit according to claim 7, wherein the remote control has a size input menu usable to input a size of an air conditioning target space, and the controller is configured to select the orientation of the Coanda vane based on the size of the air conditioning target space when the size of the air conditioning target space is inputted via the size input menu.

9. The airflow direction control device of the air-conditioning indoor unit according to claim 7, wherein the remote control has a distance input menu usable to input an opposing distance from the blow-out port to an opposite wall forward from the blow-out port; and the controller is configured to determine the orientation of the Coanda vane based on the opposing distance when the opposing distance is inputted via the distance input menu.

10. The airflow direction control device of the air-conditioning indoor unit according to claim 1, further comprising a distance sensor arranged and configured to measure a distance from the blow-out port to an opposite wall forward from the blow-out port, the controller is configured to determine the orientation of the Coanda vane based on a value measured by the distance sensor.

11. An air-conditioning indoor unit including the airflow direction control device according to claim 1.

* * * * *